US009903360B2

(12) United States Patent
Rogers

(10) Patent No.: US 9,903,360 B2
(45) Date of Patent: Feb. 27, 2018

(54) OVER-CENTER LINKAGE

(71) Applicant: Carlisle Fluid Technologies, Inc., Charlotte, NC (US)

(72) Inventor: John Anthony Rogers, Broadstone Dorset (GB)

(73) Assignee: Carlisle Fluid Technologies, Inc., Charlotte, NC (US)

( * ) Notice: Subject to any disclaimer, the term of this patent is extended or adjusted under 35 U.S.C. 154(b) by 0 days.

(21) Appl. No.: 15/256,605

(22) Filed: Sep. 4, 2016

(65) Prior Publication Data

US 2016/0369787 A1 Dec. 22, 2016

Related U.S. Application Data

(63) Continuation of application No. 13/635,748, filed as application No. PCT/US2011/028623 on Mar. 16, 2011, now Pat. No. 9,447,780.

(30) Foreign Application Priority Data

Mar. 19, 2010 (GB) ..... 1004604.3

(51) Int. Cl.
*F04B 9/135* (2006.01)
*F04B 43/073* (2006.01)
(Continued)

(52) U.S. Cl.
CPC ..... *F04B 43/073* (2013.01); *F04B 7/0015* (2013.01); *F04B 39/08* (2013.01);
(Continued)

(58) Field of Classification Search
CPC ..... F04B 9/133; F04B 9/135; F04B 9/1315; F04B 43/0736; F04B 45/0536
(Continued)

(56) References Cited

U.S. PATENT DOCUMENTS 326,545 A 9/1885 Class et al.
4,172,698 A 10/1979 Hinz et al.
(Continued)

FOREIGN PATENT DOCUMENTS

DE 102006015675 A1 10/2007
EP 0237677 A1 9/1987
(Continued)

OTHER PUBLICATIONS

PCT International Search Report and Written Opinion; Application No. PCT/US2011/028623; dated Jun. 15, 2011; 9 pages.
(Continued)

*Primary Examiner* — Peter J Bertheaud
(74) *Attorney, Agent, or Firm* — Fletcher Yoder, P.C.

(57) ABSTRACT

A novel changeover mechanism for a compressed air driven double diaphragm pump comprises a shaft slidably mounted through aligned apertures in opposing surfaces of the twin diaphragm chambers. At the center of the shaft between the two diaphragm chambers is provided an annular notch in to which is located an arm extending from a U shaped frame. The U shaped frame is pivotally mounted atop a valve plate which includes multiple ports. Positioned against a surface of the valve plate is a valve closure component which is configured to slide across the surface selectively obstructing the multiple ports. The valve closure component is held in place by a metal peg hingedly mounted in slots provided in parallel extension of the U shaped frame. Linear tension springs connect the hinged wire pusher with U shaped frame adjacent the pivot point. The springs bias the position of the valve closure component against the valve plate in an off center position.

21 Claims, 5 Drawing Sheets

(51) Int. Cl.
*F04B 7/00* (2006.01)
*F04B 39/08* (2006.01)
*F04B 53/10* (2006.01)

(52) U.S. Cl.
CPC ..... *F04B 43/0736* (2013.01); *F04B 53/10* (2013.01); *F04B 9/135* (2013.01)

(58) Field of Classification Search
USPC ..... 417/393, 395
See application file for complete search history.

(56) References Cited

U.S. PATENT DOCUMENTS 4,406,596 A 9/1983 Budde
4,597,414 A 7/1986 Johnson
5,240,390 A 8/1993 Kvinge et al.
5,664,940 A * 9/1997 Du ..... F04B 43/0736 417/393
2010/0215519 A1 8/2010 Krebs et al.

FOREIGN PATENT DOCUMENTS

EP 0780574 A1 6/1997
JP H05288159 A 11/1993
JP 3387895 B2 3/2003

OTHER PUBLICATIONS

EP Examination Report; Application No. EP 11710626.0; dated Nov. 26, 2015; 4 pages.
GB Examination Report; Application No. GB 1004604.3; dated Dec. 17, 2015; 4 pages.

* cited by examiner

OVER-CENTER LINKAGE

CROSS REFERENCE TO RELATED APPLICATIONS

This application claims benefit and is a continuation of U.S. patent application Ser. No. 13/635,748, entitled "Over-Center Linkage", filed Sep. 18, 2012, which is herein incorporated by reference in its entirety, which is a National Stage of PCT Application No. US/2011/028623, entitled "Over-Center Linkage", filed Mar. 16, 2011, which is herein incorporated by reference in its entirety, and which claims priority to United Kingdom Application No. 1004604.3, entitled "Over-Center Linkage", filed Mar. 19, 2010, which is herein incorporated by reference in its entirety.

BACKGROUND

The present invention relates to diaphragm pumps and in particular to compressed air driven double diaphragm pumps.

Compressed air driven double diaphragm pumps are known. Such pumps are commonly used in paint spraying applications. Typically these pumps comprise twin air regulators which independently control the pump and spray gun pressures, plus an outlet fluid filter/bypass pressure dump assembly along with a filtered inlet for providing clean and filtered fluid to the spray gun. The contents of the fluid material container can be constantly replenished whilst the pump is in operation, enabling all of the spray material to be used without waste thereby minimizing down time and facilitating quick and simple color change operations.

DETAILED DESCRIPTION OF SPECIFIC EMBODIMENTS

Figure 1:
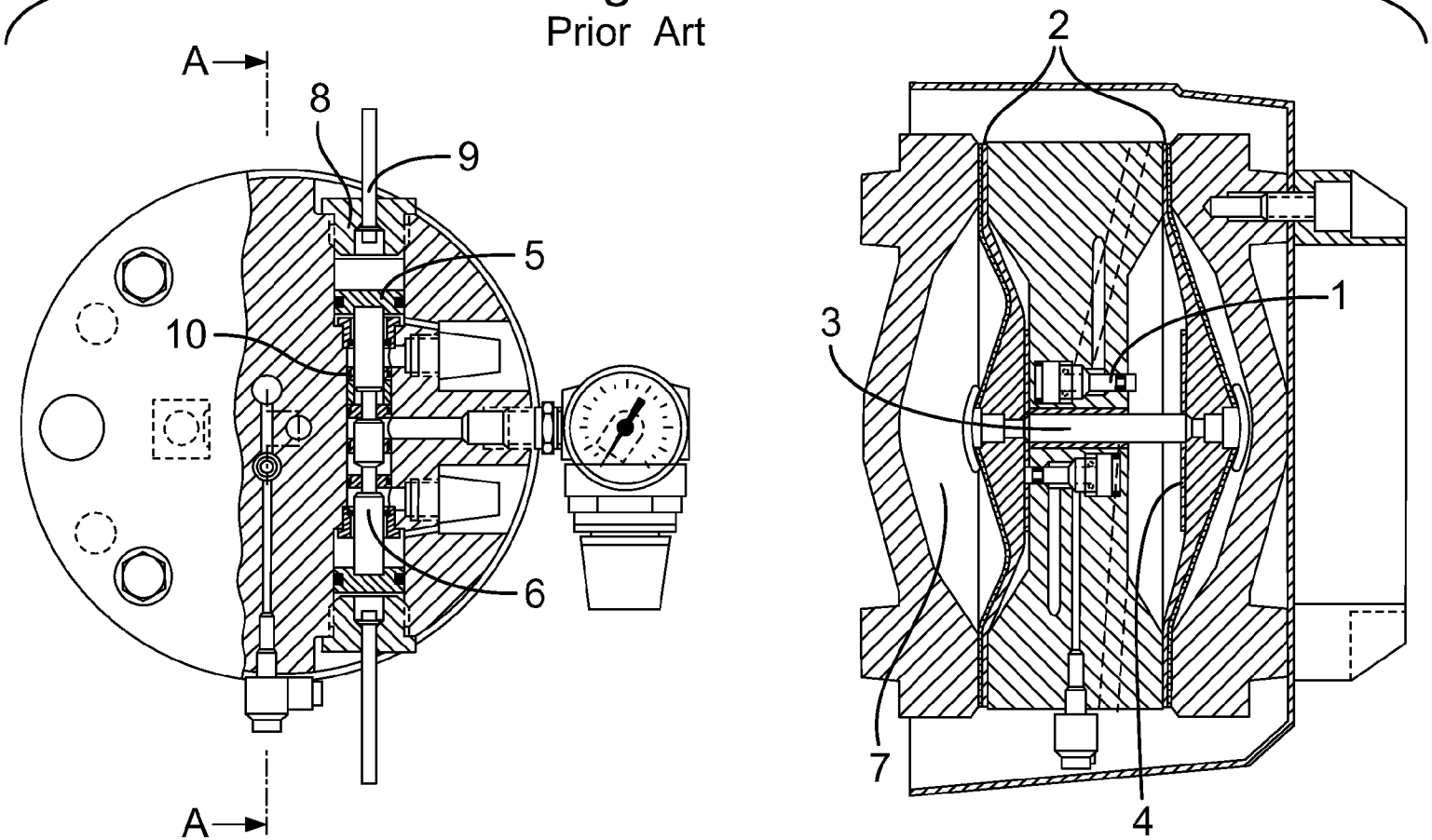
Fig. 1 Prior Art
FIG. 1 shows a double diaphragm pump using poppet valves as is known from the prior art and described briefly above.

The construction of a typical prior art valve is illustrated and further described in FIG. 1 below.

In this prior art design, changeover of the pump is achieved through poppet valves which are alternately operated by a washer located on the inside of twin diaphragms. When operated, a poppet valve is configured to effect a change in position of a control valve to reverse the direction of the pump by pressurizing and exhausting the inner diaphragm chambers alternately.

The prior art design is for the most part effective; however the inventors have identified some areas for improvement. For example, variations in manufacturing tolerances can result in the seals applying excessive friction to the valve which can cause unwanted positioning mid stroke, stopping the pump from operating. In this situation it becomes necessary to reset the pump. Resetting requires manual intervention and a consequent down time of the pump.

The present invention provides a novel and alternative mechanism for effecting changeover of the pump. The proposed mechanism provides an effective and more reliable pump without compromise on manufacturing and running costs.

In accordance with the present invention there is provided a compressed air driven double diaphragm pump including a twin pair of diaphragm chambers and a changeover mechanism configured alternately to pressurize and exhaust the two diaphragm chambers, the changeover mechanism comprising a shaft slidably mounted through aligned apertures in opposing surfaces of the twin diaphragm chambers, means for driving the shaft to move axially in forward and reverse directions, a valve comprising a fixed valve plate having a plurality of ports in fluid communication with the twin diaphragm chambers and a valve closure component slidably mounted with respect to the fixed valve plate for selectively closing one or more of the ports, an arm pivotably mounted with respect to the valve and engaging with the shaft, the fixed valve plate hingedly linking with the arm and resilient biasing means associated with the hinged link for biasing the position of the valve closure component to off center of the valve plate.

In use the shaft is driven to move axially. As the shaft moves, it carries the arm causing it to pivot about the pivot point adjacent the valve thereby pushing the valve closure component along the valve plate. The resilient biasing means ensure continuing close contact between the valve plate and valve closure component. As the valve closure component travels across the valve plate it opens ports communicating with one of the twin diaphragms and closes ports communicating with the other diaphragm. Reverse movement of the shaft brings about the opposite. The mechanism thus switches pressurization and exhaustion between the diaphragms changing direction of the pump.

In a preferred embodiment, the arm comprises a substantially U shaped frame pivotally fixed on two opposing surfaces of the valve plate and slots provided in parallel extensions of the frame, a hinge received in the slots and connecting with a pair of linear tension springs which in turn are secured to the frame adjacent the pivot points.

An advantage of the present invention is that it permits an easily retrofittable module to be provided which can be installed or removed from the pump for maintenance or repair without the need for disassembly of any major components of the pump. In accordance with an aspect of the invention such a module is provided independently of the pump.

The prior art arrangement and an embodiment of the invention are now described.

As can be seen from FIG. 1, a prior art pump includes a pair of poppet valves (1), each directionally controlling pressurization and exhaustion of one of a twin pair of diaphragms (2). The diaphragms are linked by a slidably mounted shaft (3) configured to move axially in a forward and reverse direction as the diaphragms (2) inflate and deflate. A washer (4) located in between the diaphragms (2) alternately operates the poppet valves (1).

When operated each poppet valve (1) provides a pneumatic signal to the outside of a piston (5). This causes the control valve (6) to change position and reverse the direction of the pump by pressurizing and exhausting the inner diaphragm chamber (7) with which the poppet valve (1) is associated. As the poppet valves (1) are alternately operated, the diaphragm chambers (7) are alternately pressurized and exhausted.

The signal produced by the poppet valves (1) are only present while being depressed, the air operating the piston (5) is exhausted by the clearance between the end cap (8) and pin (9) once the poppet valve (1) is closed.

As discussed above, variation in tolerances can cause the seals (10) to apply excessive friction to the control valve (6), which can cause the control valve (6) to be positioned mid stroke and cause the pump to stop. This can be reset by manual intervention using the pin (9).

Figure 2:
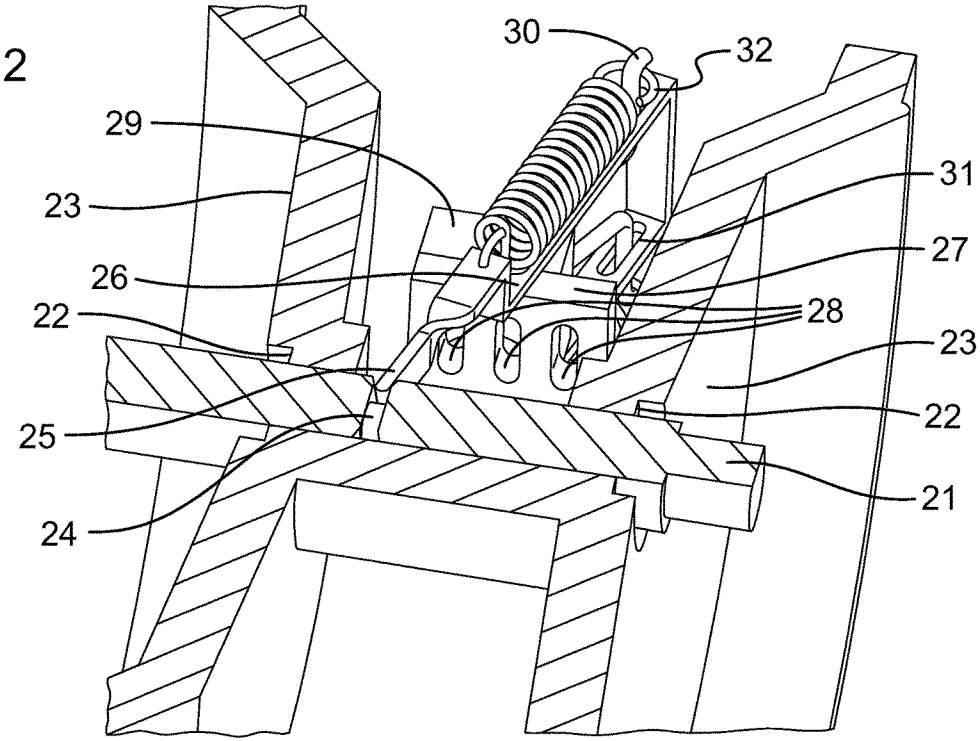
FIG. 2 shows a section through one embodiment of the present invention with the valve in a first position.

FIG. 2 shows a first view of an embodiment of a pump in accordance with the invention. The Figure shows only the detail of the novel changeover mechanism of the pump. Other features of the pump are as known from the prior art.

The novel mechanism comprises a shaft (21) slidably mounted through aligned apertures (22) in opposing surfaces of the twin diaphragm chambers (23). At the center of the shaft (21) between the two diaphragm chambers (23) is provided an annular notch (24) in to which is located an arm (25) extending from a U shaped frame (26). The U shaped frame (26) is pivotally mounted atop a valve plate (27) by means of a pivot (see FIG. 5 reference (34)) which includes multiple ports (28). Positioned against a surface of the valve plate (27) is a valve closure component (29) which is configured to slide across the surface selectively obstructing the multiple ports (28).

The valve closure component (29) is held in place by a wire pusher or similar wire form fastener (30) hingedly mounted in slots (31) provided in parallel extension of the U shaped frame (26). Linear tension springs (32) connect the hinged peg (30) with U shaped frame (26) adjacent the pivot point. The springs (32) bias the position of the valve closure component (29) against the valve plate (27) in an off center position.

Figure 3:
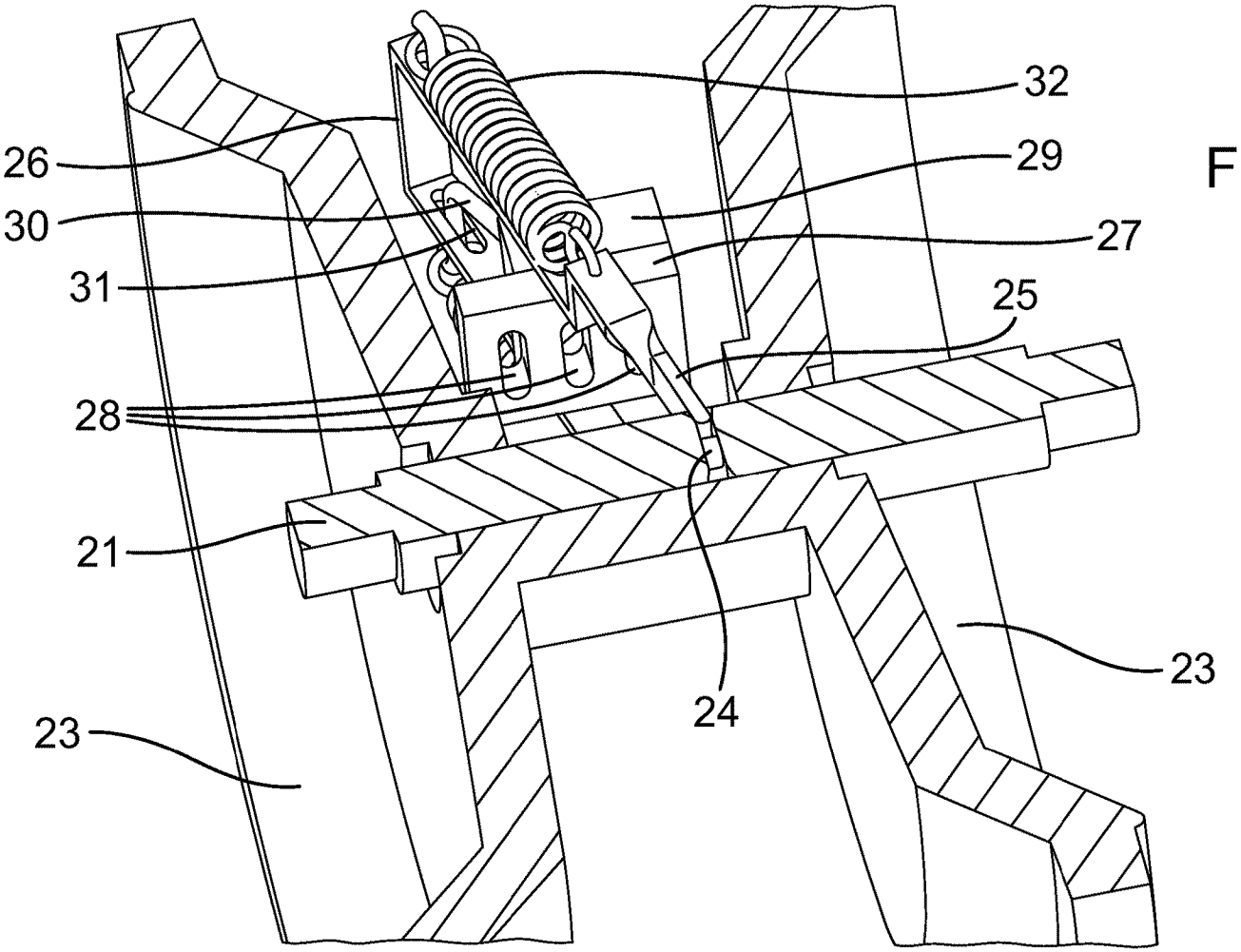
FIG. 3 shows a section through the embodiment of with the valve in a second position.

FIG. 3 shows the embodiment of FIG. 2 after switching of the pump has occurred. As can be seen shaft (21) has travelled axially in a direction from the left toward the right diaphragm chamber (23). Movement of the shaft (21) cause the notch (24) to drag the arm (25) causing rotation of the U shaped frame (26) about the pivot and consequentially sliding of the valve closure component (29) across the valve plate (27) opening ports (28) to the left of the figure and closing ports (28) to the right of the Figure. This results in exhaustion of the chamber (23) to the right of the Figure and pressurization of the chamber (23) to the left of the Figure.

Figure 4:
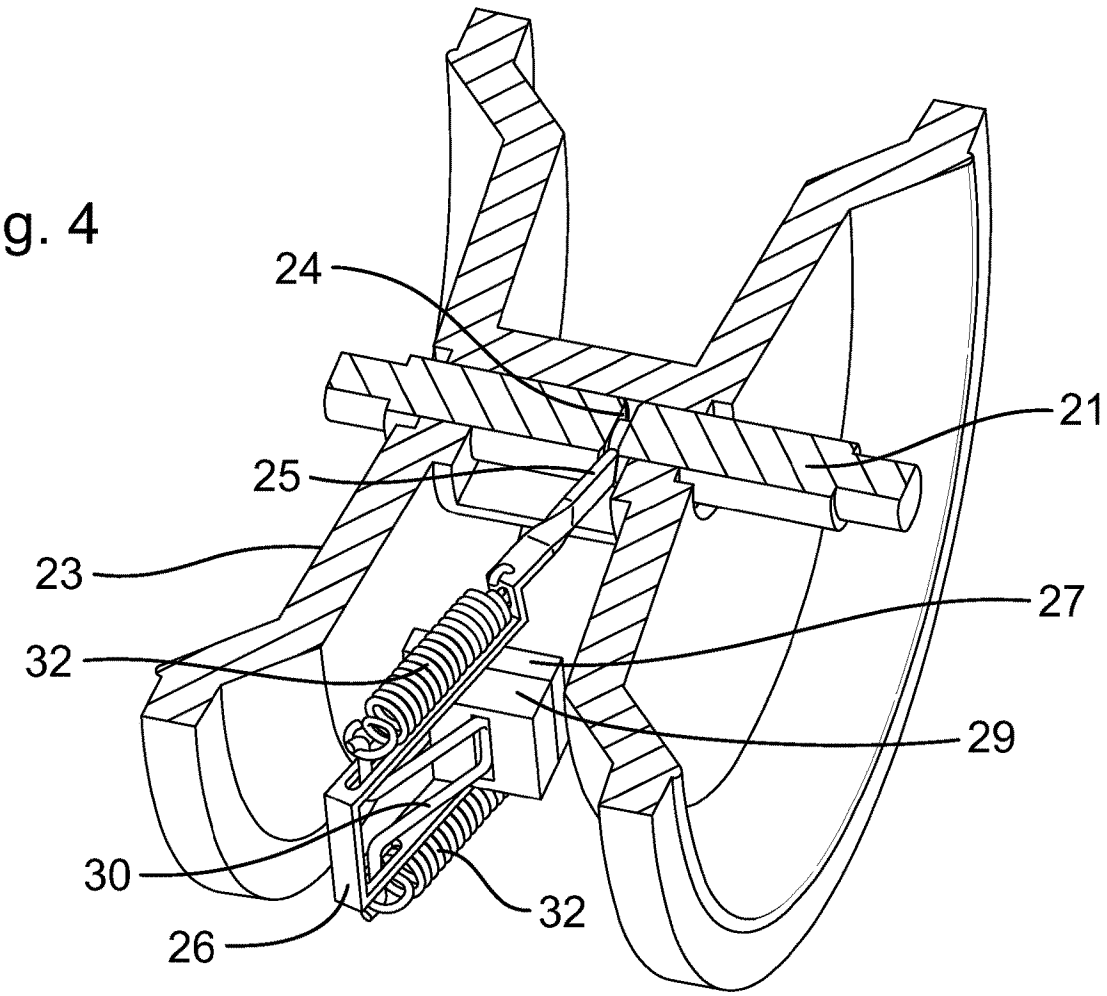
FIG. 4 shows an alternative section view of the embodiment of FIGS. 2 and 3.

FIG. 4 shows the embodiment of FIGS. 2 and 3 better illustrating the valve closure member (29), wire pusher (30), U shaped frame (26) and springs (32).

Figure 5:
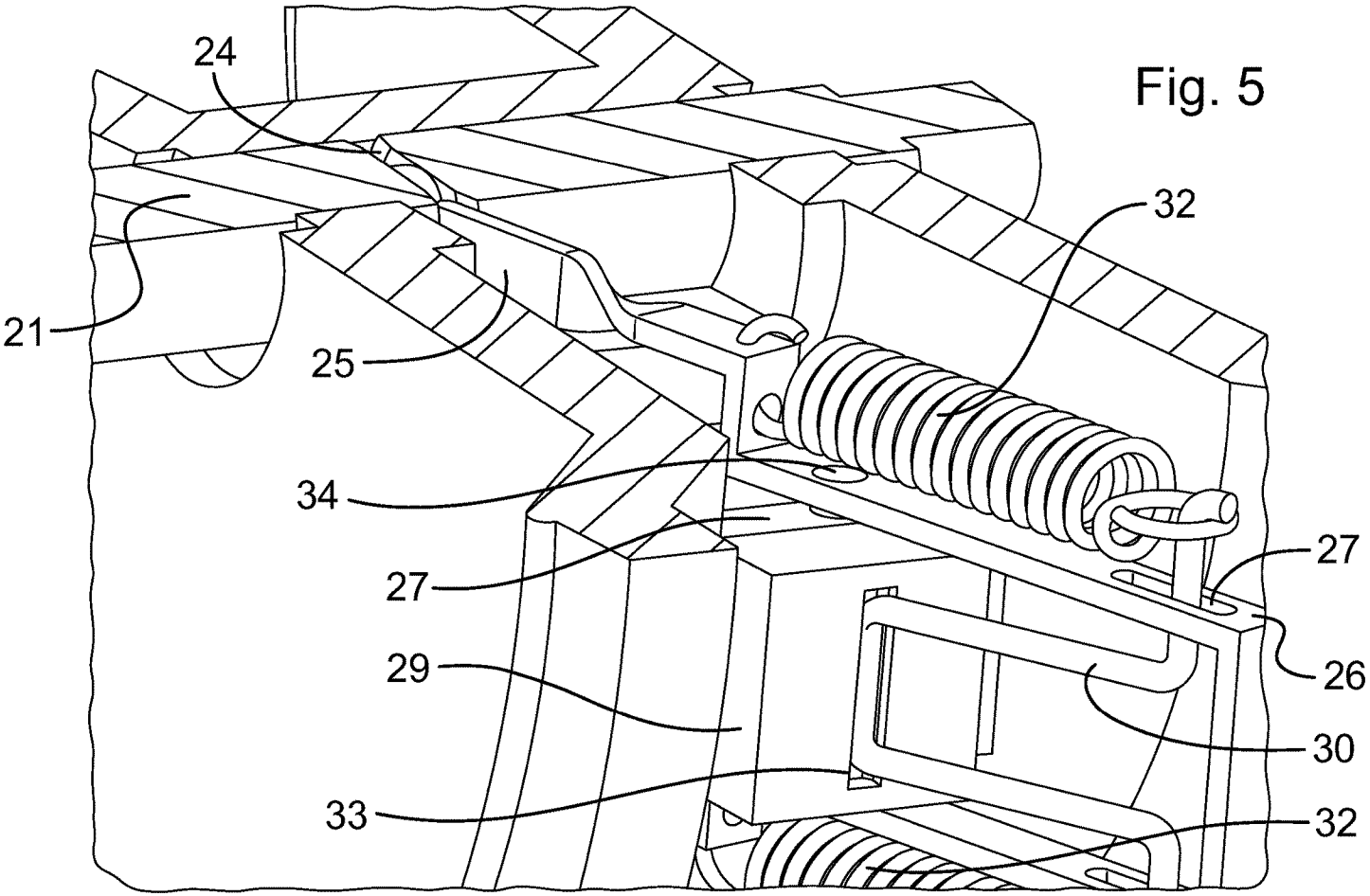
FIG. 5 shows change over mechanism of the embodiment of FIGS. 2 to 4 in closer detail.

FIG. 5 provides a closer view of the components detailed in FIG. 4 from another perspective. As can be seen the wire pusher (30) locates securely in a slot (33) provided in the rear of the valve closure component (29) thereby to retain the component against the valve plate (27).

The invention claimed is:

1. A compressed air driven double diaphragm pump including a twin pair of diaphragm chambers and a changeover mechanism configured alternately to pressurize and exhaust the two diaphragm chambers, the changeover mechanism comprising a shaft slidably mounted through aligned apertures in opposing surfaces of the twin diaphragm chambers, means for driving the shaft to move axially in forward and reverse directions, a valve comprising a fixed valve plate having a plurality of ports in fluid communication with the twin diaphragm chambers and a valve closure component slidably mounted with respect to the fixed valve plate for selectively closing one or more of the ports, an arm pivotably mounted with respect to the valve and engaging with the shaft, the fixed valve plate hingedly linking with the arm and resilient biasing means associated with the hinged link for biasing the position of the valve closure component to off center of the fixed valve plate, wherein the arm comprises a substantially U-shaped frame pivotally mounted in relation to two opposing surfaces of the valve plate and slots provided in parallel extensions of the frame, a hinge is received in the slots and connects with a pair of linear tension springs which in turn are secured to the frame adjacent pivot points of the arm relative to the fixed plate.

2. A compressed air driven double diaphragm pump as claimed in claim 1, wherein the arms are mounted on the two opposing surfaces.

3. A compressed air driven double diaphragm pump as claimed in claim 1, further including a pivot element extending from the fixed valve plate to the arm, wherein the pivot element is directly connected to the arm and the fixed valve plate.

4. A compressed air driven double diaphragm pump as claimed in claim 3, wherein the pivot element comprises a cylindrical shaft.

5. A compressed air driven double diaphragm pump as claimed in claim 1, wherein the fixed valve plate pivotally supports the arm.

6. A compressed air driven double diaphragm pump as claimed in claim 1, wherein the fixed valve plate provides a reaction force against movement of the arm in a first direction away from the fixed valve plate that is normal to a surface of the fixed valve plate in which openings of the ports are located and movement of the valve closure component in a direction opposite the first direction.

7. A compressed air driven double diaphragm pump as claimed in claim 1, wherein the arm extends crosswise to the fixed valve plate.

8. A compressed air driven double diaphragm pump as claimed in claim 1, wherein the resilient biasing means associated with the hinged link biases the valve closure component against the fixed valve plate.

9. A self-contained and retrofittable module for a compressed air driven double diaphragm pump comprising a twin pair of diaphragm chambers and a changeover mechanism configured alternately to pressurize and exhaust the two diaphragm chambers, the changeover mechanism comprising a shaft slidably mounted through aligned apertures in opposing surfaces of the twin diaphragm chambers, means for driving the shaft to move axially in forward and reverse directions, a valve comprising a fixed valve plate having a plurality of ports in fluid communication with the twin diaphragm chambers and a valve closure component slidably mounted with respect to the fixed valve plate for selectively closing one or more of the ports, an arm pivotably mounted with respect to the valve and engaging with the shaft, the fixed valve plate hingedly linking with the arm and resilient biasing means associated with the hinged link for biasing the position of the valve closure component to off center of the fixed valve plate, wherein the arm comprises a substantially U-shaped frame pivotally mounted in relation to two opposing surfaces of the valve plate and slots provided in parallel extensions of the frame, a hinge is received in the slots and connects with a pair of linear tension springs which in turn are secured to the frame adjacent pivot points of the arm relative to the fixed plate.

10. A module as claimed in claim 9, wherein the arms are mounted on the two opposing surfaces.

11. A module as claimed in claim 9, further including a pivot element extending from the fixed valve plate to the arm, wherein the pivot element is directly connected to the arm and the fixed valve plate.

12. A module as claimed in claim 11, wherein the pivot element comprises a cylindrical shaft.

13. A module as claimed in claim 9, wherein the fixed valve plate pivotally supports the arm.

14. A module as claimed in claim 9, wherein the fixed valve plate provides a reaction force against movement of the arm in a first direction away from the fixed valve plate that is normal to a surface of the fixed valve plate in which openings of the ports are located and movement of the valve closure component in a direction opposite the first direction.

15. A module as claimed in claim 9, wherein the arm extends crosswise to the fixed valve plate.

16. A module as claimed in claim 9, wherein the resilient biasing means associated with the hinged link biases the valve closure component against the fixed valve plate.

17. A compressed air driven double diaphragm pump including a twin pair of diaphragm chambers and a changeover mechanism configured alternately to pressurize and exhaust the two diaphragm chambers, the changeover mechanism comprising a shaft slidably mounted through aligned apertures in opposing surfaces of the twin diaphragm chambers, means for driving the shaft to move axially in forward and reverse directions, a valve comprising a fixed valve plate having a plurality of ports in fluid communication with the twin diaphragm chambers and a valve closure component slidably mounted with respect to the fixed valve plate for selectively closing one or more of the ports, an arm pivotably mounted with respect to the valve and engaging with the shaft, the fixed valve plate hingedly linking with the arm and resilient biasing means associated with the hinged link for biasing the position of the valve closure component to off center of the fixed valve plate, wherein the arm comprises a substantially U-shaped frame pivotally mounted in relation to two opposing surfaces of the fixed valve plate and slots provided in parallel extensions of the frame, a hinge wire pusher or fastener is received in the slots and connects with a pair of linear tension springs which in turn are secured to the frame adjacent its pivot point, the wire pusher or fastener holding the valve closure component against the fixed valve plate.

18. A compressed air driven double diaphragm pump as claimed in claim 17, wherein the substantially U-shaped frame is mounted on the two opposing surfaces.

19. A compressed air driven double diaphragm pump as claimed in claim 17, wherein the changeover mechanism is configured as a self-contained and retrofittable module.

20. A compressed air driven double diaphragm pump as claimed in claim 17, wherein the pair of linear tension springs bias the position of the valve closure component against the fixed valve plate in an off center position.

21. A compressed air driven double diaphragm pump as claimed in claim 17, wherein the center of the shaft between the twin pair of diaphragm chambers is provided an annular notch into which is located the arm extending from the substantially U-shaped frame.

* * * * *